US010627183B2

(12) United States Patent
Crouch

(10) Patent No.: US 10,627,183 B2
(45) Date of Patent: Apr. 21, 2020

(54) PORTABLE DRY FIRE PRACTICE SHOOTING SYSTEM

(71) Applicant: Joe Jenius Inc., Los Angeles, CA (US)

(72) Inventor: Joseph Crouch, Los Angeles, CA (US)

(73) Assignee: Joe Jenius Inc., Los Angeles, CA (US)

( * ) Notice: Subject to any disclaimer, the term of this patent is extended or adjusted under 35 U.S.C. 154(b) by 413 days.

(21) Appl. No.: 15/370,179

(22) Filed: Dec. 6, 2016

(65) Prior Publication Data

US 2017/0261283 A1 Sep. 14, 2017

Related U.S. Application Data

(60) Provisional application No. 62/306,074, filed on Mar. 10, 2016.

(51) Int. Cl.

| | |
|---|---|
| ***F41A 33/02*** | (2006.01) |
| ***F41G 3/26*** | (2006.01) |
| ***F41J 5/14*** | (2006.01) |

(52) U.S. Cl.

CPC ..... *F41A 33/02* (2013.01); *F41G 3/2611* (2013.01); *F41G 3/2655* (2013.01); *F41J 5/14* (2013.01)

(58) Field of Classification Search

CPC ..... F41A 33/00; F41A 33/02; F41A 33/04; F41A 33/06; F41G 3/26; F41G 3/2655; F41G 3/2611; F41G 3/2662; F41J 5/14; A45F 5/02; F16M 11/06; F16M 13/00; G03B 17/561; H04N 5/23; H04N 5/206; H04N 5/23216; H04N 5/23293; H04M 1/0202; H04M 1/035; H04M 21/44218; H04M 21/812

See application file for complete search history.

(56) References Cited

U.S. PATENT DOCUMENTS

| | | | | |
|---|---|---|---|---|
| 3,957,358 | A * | 5/1976 | Holliday | G02B 25/005 359/804 |
| 2007/0190495 | A1* | 8/2007 | Kendir | F41A 33/02 434/21 |
| 2013/0075543 | A1* | 3/2013 | Krohn | G06F 1/1632 248/121 |
| 2014/0097306 | A1* | 4/2014 | Hale | G03B 17/566 248/122.1 |
| 2015/0292842 | A1* | 10/2015 | Pixton | F41J 1/10 273/407 |
| 2015/0346588 | A1* | 12/2015 | Hudson | G03B 17/561 248/220.22 |
| 2016/0313630 | A1* | 10/2016 | Elmohtaseb | G03B 17/561 |
| 2017/0067597 | A1* | 3/2017 | Prugue | A42B 3/04 |

* cited by examiner

*Primary Examiner* — Timothy A Musselman
(74) *Attorney, Agent, or Firm* — Kelly & Kelley, LLP

(57) ABSTRACT

A portable dry fire practice shooting system includes a first base supporting a target. A second base is associated with the first base such that the distance between the first base and the second base can be selectively adjusted. The second base includes a portable electronic device retaining mechanism for holding a portable electronic device on the second base so as to align a camera of the portable electronic device with the target. A software application downloaded onto the portable electronic device utilizes the camera of the portable electronic device to detect light spots reflecting from the target.

81 Claims, 8 Drawing Sheets

PORTABLE DRY FIRE PRACTICE SHOOTING SYSTEM

RELATED APPLICATIONS

This application claims priority to United States Provisional Application No. 62/306,074, filed on Mar. 10, 2016.

BACKGROUND OF THE INVENTION

The present invention generally relates to methods and systems for practicing one's shot with a firearm. More particularly, the present invention relates to a dry fire practice shooting system which is portable and can be used in connection with a portable electronic device, such as a smartphone or the like.

Guns are owned and used for a variety of reasons. Guns may be used and owned for hunting purposes, for sport, for the defense of one's self or others, or in some cases as part of one's profession, such as those in the military, police, security and the like.

Regardless of the situation, the gun owner needs to be very familiar with his or her gun so as to be able to rely on his or her instincts when forced to make decisions under extreme stress when using the gun. Thus, it is very important for a gun owner to be very familiar with his or her gun and to practice using the gun on a regular basis. Accurate shooting is an acquired skill. Developing proficiency with any motor skill requires a significant amount of repetitions.

Some gun owners are able to practice shooting outdoors in a rural area. However, local and state laws regulate where it is legal to shoot a firearm outdoors and this option is not available to all gun owners. Moreover, some gunowners live in suburban and urban areas and instead use an indoor shooting range or an outdoor shooting range facility.

However, there are drawbacks associated with such live firing either outdoors or at a shooting range. The gun owner must take the time to drive to the shooting range or outdoor area. Shooting ranges require an entrance fee or a membership. In all live fire practice situations, there is the expense of spent ammunition. As it can take thousands of repetitions to commit an action to muscle memory, for a shooter that can represent a considerable amount of ammunition to perfect his or her trigger squeeze and shooting accuracy. Due to the loud noise from the discharge of a gun and the recoil of the gun, shooters sometimes develop bad habits such as flinching, eye blinking, lack of follow-through, turning the head to look away, and the like. Some of these bad habits are difficult to detect during live fire training.

Due to these drawbacks, dry fire practice shooting has developed and is even encouraged by shooting instructors. The idea of dry fire is to develop muscle memory through repetition without actually shooting live ammunition. Shooting is a deteriorating skill and studies have shown that in as little as one week after leaving the shooting range an average shooter's skills may diminish by as much as twenty percent. Dry fire training allows a shooter to continually practice, maintaining and improving their skills while away from the live shooting range. Dry fire training represents an affordable training alternative. Dry fire practice shooting has been found to be excellent for treating flinching as there is no recoil of the gun, and without the fear of a loud noise or physical injury the brain can improve the skill of pulling the trigger without disturbing the gun. Dry fire practice shooting has also been found to create less trigger jerking. Trigger jerk is a trigger pulled that disrupts the gun's aiming point. Perfecting a trigger squeeze is as important as properly sighting the firearm to the target. Once again, these skills require thousands of repetitions on an ongoing basis to perfect and maintain.

There are shortcomings associated with existing dry fire systems and methods, however. In some cases, the gun owner merely removes the magazine and all ammunition from his or her firearm and practices aiming and squeezing the trigger in order to simulate firing of the firearm in a repetitive manner. However, there is no feedback as it relates to whether the shooter has properly sighted his or her firearm on the intended target. This can also become repetitious and dull quite quickly and the firearm owner may lose interest.

There are other systems wherein a laser light emitting device simulating a firearm is used. In such cases, the user will have the benefit of being able to see where the laser hits a target and thus ascertain whether he or she is shooting accurately. In some cases, the target may comprise a sensor array which detects the laser light. However, these systems have drawbacks as well in that it is recommended to practice with one's own firearm to become familiar with that particular firearm. Moreover, replacing one's handgun with a replica adds to the cost of gun ownership and training, which costs can be significantly increased by having to purchase an electronic target which senses the laser light emitted thereon. In some cases, these dry fire systems and methods must be established similar to a shooting range, such as in a basement or dedicated room of one's house.

Accordingly, there is a continuing need for a dry fire practice shooting system which is portable. Such a dry fire practice shooting system should also enable the owner to utilize his or her own firearm when practicing. What is also needed is a portable dry fire practice shooting system which provides shooting accuracy feedback to the gun owner. The present invention fulfills these needs, and provides other related advantages.

SUMMARY OF THE INVENTION

The present invention relates to a dry fire practice shooting system which is portable and which provides feedback to the user thereof. The system generally comprises a first base supporting a target. Typically, a target frame extends from the first base which holds the target. The target frame may include an open edge and channels formed along generally opposite sidewalls for removably retaining the target therein.

The target frame may be movably connected to the first base. For example, the first base in the target frame may be connected by a tongue and groove connection, permitting the target frame to be slidably moved with respect to the first base. The target frame may also be detachably connected to the first base.

A second base is connected to the first base such that the distance between the first base and the second base can be selectively adjusted. A slide interconnects the first base and the second base. The slide comprises a first rail extending from the first base and a second rail extending from the second base in slidable engagement with the first rail.

The second base includes a portable electronic device retaining mechanism for holding a portable electronic device on the second base so as to align a camera of the portable electronic device with the target. Preferably, the portable electronic device retaining mechanism is selectively adjustable to retain portable electronic devices of varying sizes. The portable electronic device retaining mechanism may comprise a bracket for holding the portable electronic device, including an arm extendable away from the bracket and biased in a closed position towards the bracket to retain the portable electronic device within the bracket. The portable electronic device retaining mechanism may be configured to selectively adjust an angle of the portable electronic device with respect to the target. A manual lock may be used for locking the portable electronic device at the selected angle.

A software application is downloaded onto the portable electronic device that utilizes the camera of the portable electronic device to detect light spots generated by a light emitter reflecting from the target. The light emitter may comprise a laser bullet actuated by a hammer or firing pin of a firearm. The software application creates an image of simulated shot markings on a simulated target which are displayed on an electronic display of the portable electronic device.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention is directed to a portable dry fire practice shooting system, generally referred to by the reference number 10. The system 10 of the present invention is portable so as to be useable in a variety of settings. The system 10 of the present invention also enables the user to practice shooting his or her actual firearm in virtually any setting and receive both visual and audio feedback.

Figure 1:
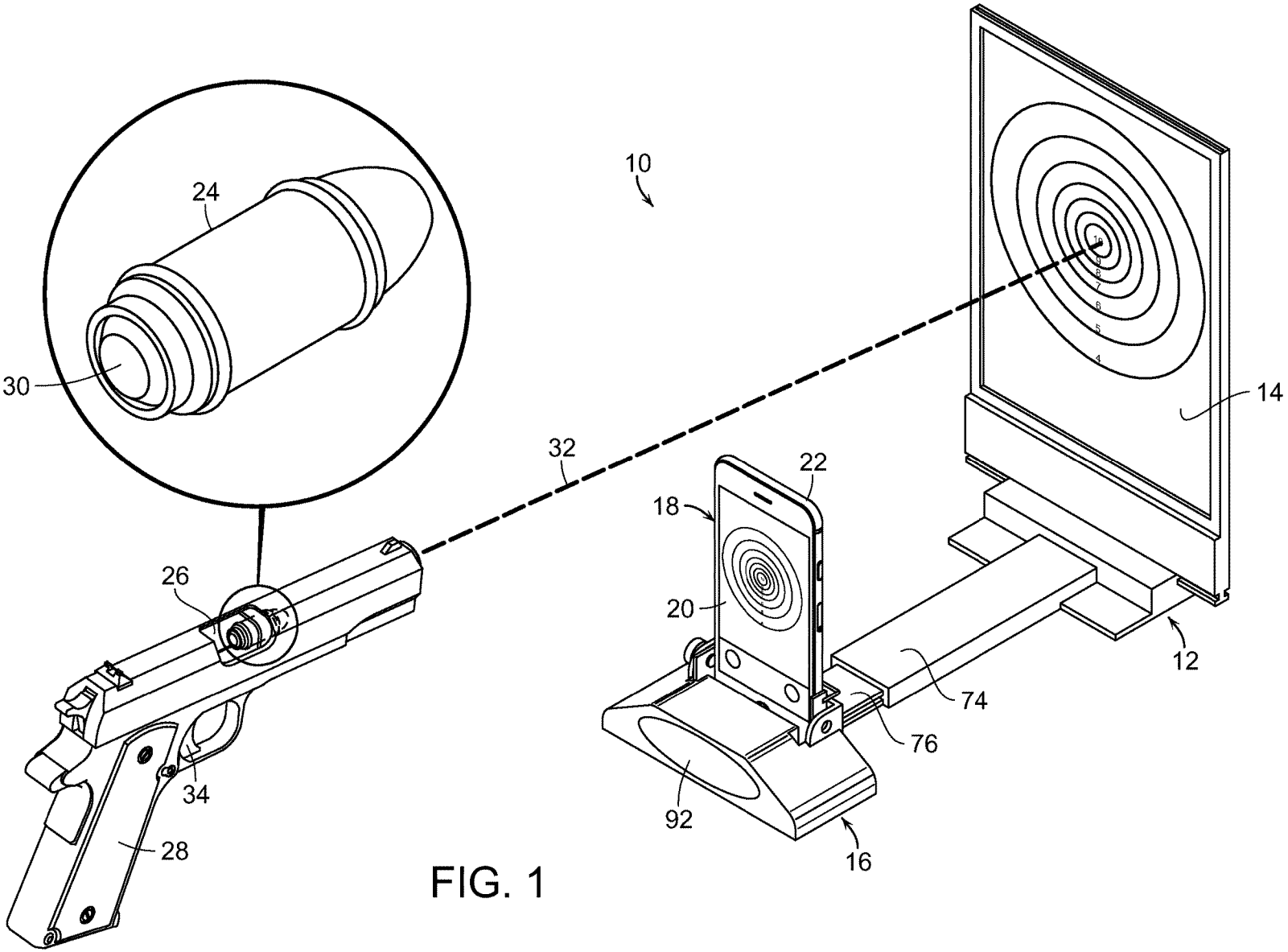
FIG. 1 is a perspective environmental view of a portable dry fire practice shooting system embodying the present invention.

With reference now to FIG. 1, a first base 12 supports a target 14, typically extending vertically upwardly therefrom, as illustrated. A second base 16, spaced apart from the first base 12 supports a portable electronic device 18 having a software application downloaded thereon which utilizes a camera of the portable electronic device 18 to detect light spots generated by a light emitter reflecting from the target 14. The light emitter may be associated with an actual or simulated firearm.

The portable electronic device 18 comprises a small and portable electronic device having a display screen 20, a camera 22 facing away from the display screen 20 so as to comprise a rear-facing camera, a processor, memory, and electronics so as to enable the downloading and use of a software application which interacts with the display 20 and rear-facing camera 22. The portable electronic device 18 typically comprises a user's smartphone, tablet or the like.

In a particularly preferred embodiment, the light emitter comprises a laser bullet 24 which is insertable into a chamber 26 of a gun or firearm 28. The laser bullet 24 is sized and configured similar to a normal cartridge or bullet which would otherwise be used by the firearm 28. However, whereas a normal cartridge would comprise a shell with a rim containing primer and gun powder, which when actuated by the hammer or firing pin of the firearm would release a bullet therefrom, the laser bullet 24 instead includes a depressible switch 30, typically comprised of a hard rubber, which is actuated by the hammer or firing pin of the firearm 28 so as to activate a laser within the laser bullet 24, such as a light emitting diode, which will result in laser light 32 being emitted from the barrel of the firearm 28 and onto the target 14. Typically, the laser bullet 24 is designed without a rim, so that an extractor of the firearm 28 which would normally eject and discharge the spent shell or casing of a regular cartridge cannot eject the laser bullet 24 from the firearm 28, enabling repeated firing of the firearm 28, creating a beam of laser light 32 from the laser bullet 24 each time the trigger 34 of the firearm 28 is pulled so as to simulate firing and shooting the weapon 28. The laser bullet 24 can be manually removed from the chamber 26 of the firearm 28 when the user is finished with the dry fire practice shooting.

Figure 2:
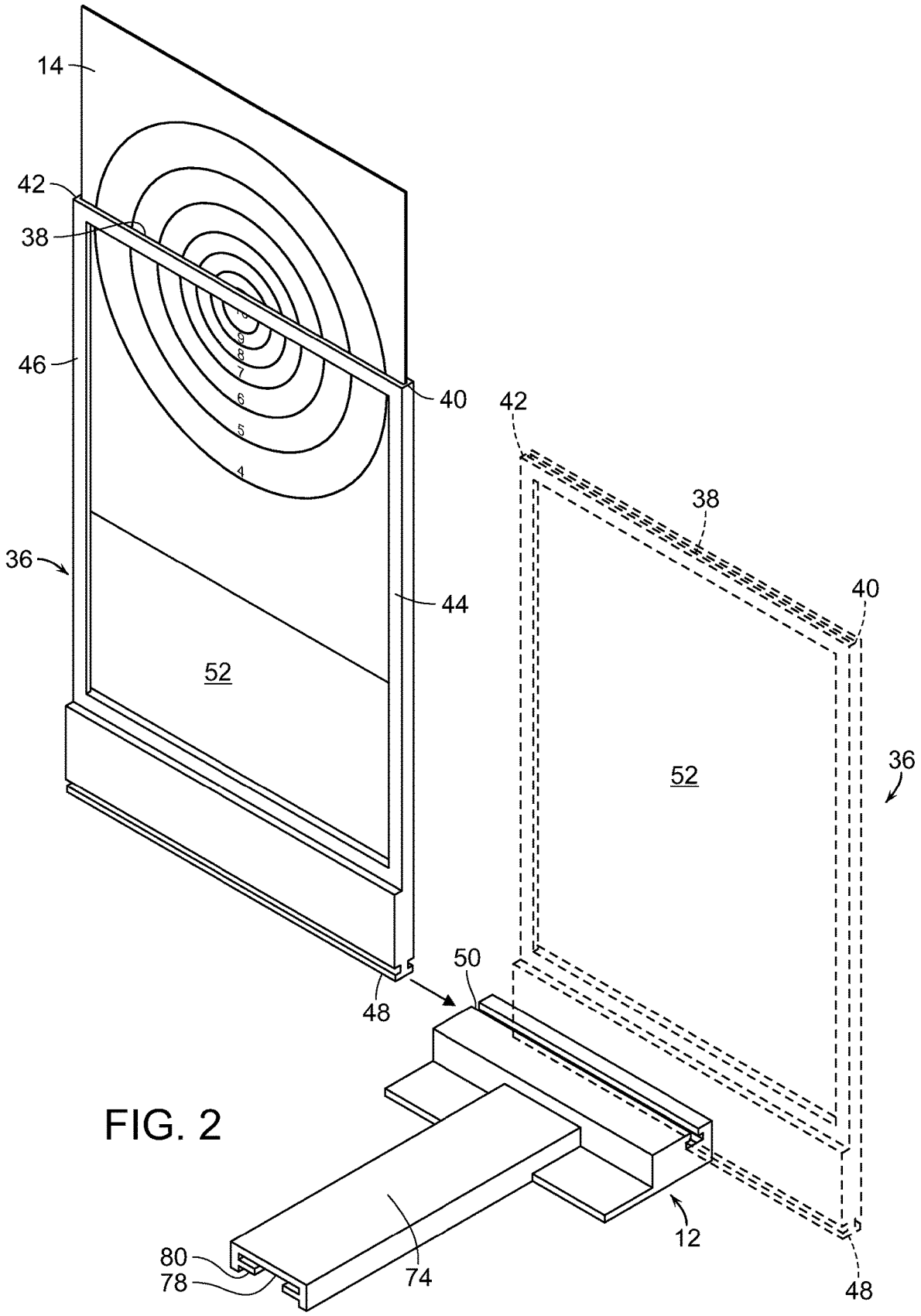
FIG. 2 is a perspective and diagrammatic view of a target frame supporting a target therein and removably connected to a first base of the system, in accordance with the present invention.

With reference now to FIG. 2, typically, the target 14 is held in a target frame 36. The target frame 36 may include an open edge 38, illustrated as the top edge, and channels 40 and 42 formed along generally opposite sidewalls 44 and 46 for removably retaining the target 14 therein. It will be understood that the open edge 38 could also comprise a side edge and does not necessarily have to be the top edge of the target frame 36. In this manner, different targets 14 may be removably inserted into the target frame 36 and used for the dry fire practice shooting.

A target 14 may be supplied as part of the system or the user may provide his or her own target 14. For example, the target 14 may be printed onto an 8.5 by 11-inch sheet of paper. The target 14 should provide sufficient reflection of the light, such as the laser light beam 32, so as to be detectable by the camera 22 of the portable electronic device 18. To facilitate the reflection of the laser light beam 32 or other light emitted onto the target 14, a sheet of vellum or plastic may be placed in front of the target 14 to provide such reflection. Typically, however a target printed on a sheet of white paper or plastic or the like is sufficiently reflective for use in the system 10 of the present invention.

With continuing reference to FIG. 2, it will be seen that the target frame 36 extends generally vertically upward from the first base 12. Preferably, the target frame 36 is movably connected to the first base, such that the target frame 36 can adjusted in its horizontal position with respect to the base 12. This can facilitate alignment of the target 14 with the camera 22 of the electronic device 18 and/or provide a clear line of sight between the user's firearm 28 and the target 14. One way of accomplishing this is to provide a tongue and groove connection between the target frame 36 and the base 12. As illustrated, the target frame 36 may include a protruding tongue 48 which is received within groove 50 of the base. An inverse relationship could also be provided, or any other means of slidably connecting the base 12 to the target frame 36 to achieve the purposes of the invention.

The target frame 36 may be detachably connected to the first base 12. Such an arrangement could make it easier for a user to insert or remove a target 14 from the target frame 36. Typically, the sidewalls 44 and 46 of the target frame 36 define an open window through which the target 14 is viewable. The window 52, however, could also be comprised of a clear sheet of material so as to view the target 14 but yet provide adequate reflection of the light reflected thereon. Removal of the target frame 36 from the first base 12 also facilitates storage and transportation of the system. It is contemplated that the target frame 36 could also be pivotally connected to the first base 12 in order to allow the target frame 36 to be selectively lowered when not in use and raised when in use.

Figure 3:
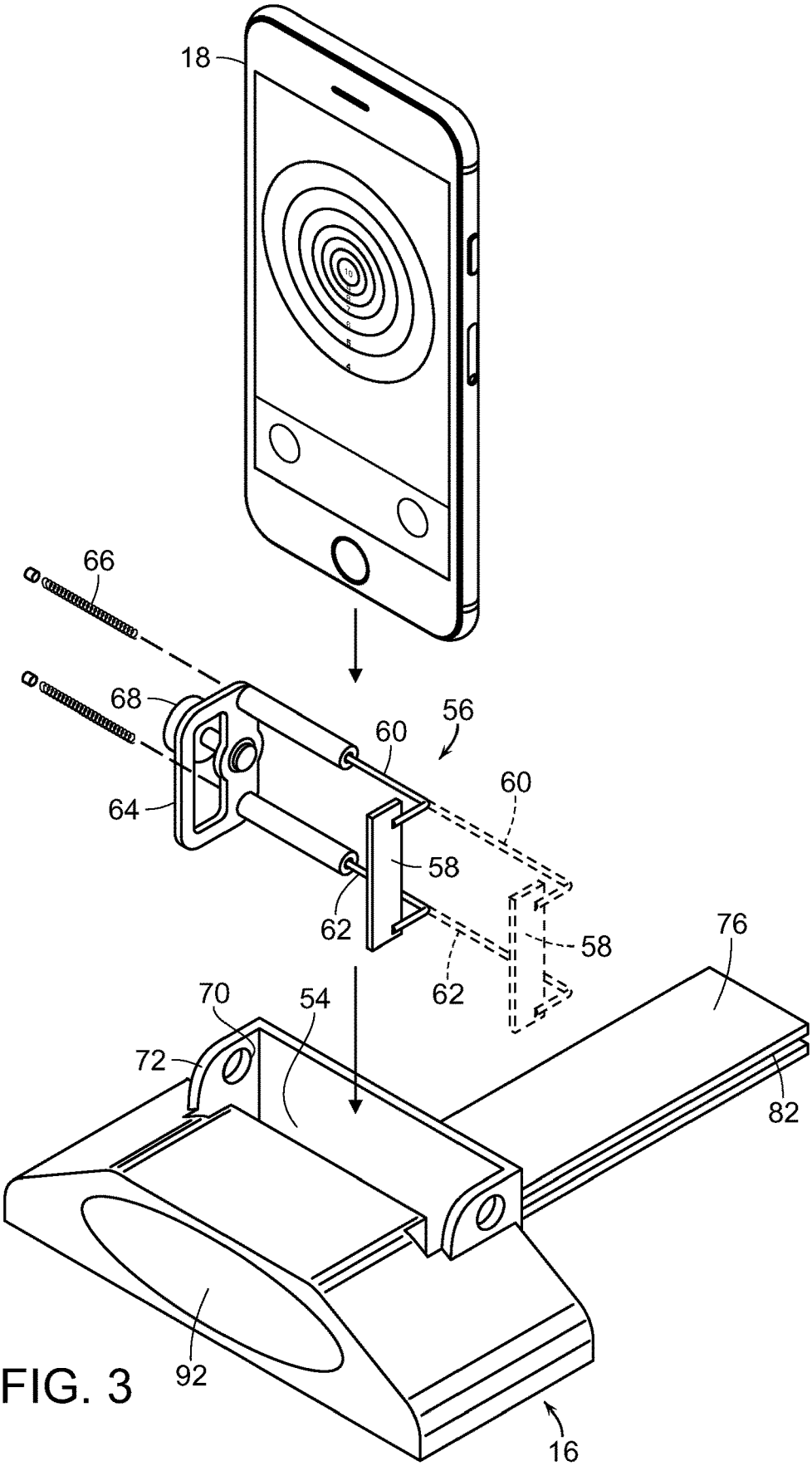
FIG. 3 is an exploded perspective view of a portable electronic device and a retaining mechanism for retaining the portable electronic device to a second base of the system.

With reference now to FIG. 3, as mentioned above, a portable electronic device 18, such as a smartphone or tablet or the like, is removably and adjustably associated with the second base 16. The second base 16 defines a well 54 which receives a bottom portion of the portable electronic device 18 therein. A retaining mechanism 56 is also associated with the second base 16, typically at least partially disposed within the well 54. The retaining mechanism 56 adjustably retains the portable electronic device 18 to the second base 16.

The retaining mechanism 56 comprises at least one side bracket 58 having at least one arm 60 attached thereto. Typically, there are two arms 60 and 62 which extend from brackets 58 and 64, between which the portable electronic device 18 is inserted. In a particularly preferred embodiment, a spring 66 is associated with at least one of the arms 60 and 62 which biases bracket 58 towards bracket 64. In this manner, it will be appreciated that the second bracket 64 may instead be a sidewall of the well 54 with the spring 66 and arms 60 and 62 extending therefrom to bracket 58. In this manner, as illustrated in FIG. 3, it can be seen that the retaining mechanism 56 is adjustable so as to secure portable electronic devices 18 of different widths or sizes to the second base 16. Typically, the retaining mechanism 56 will accommodate portable electronic devices 18 of up to approximately six inches in width so as to retain various smartphones and tablets and the like which are currently commonly used. However, the base 16 and retaining mechanism 56 can be adjusted in size, as needed, to accommodate larger portable electronic devices 18.

Once the portable electronic device 18 is inserted into the well 54 and held in place by means of biased bracket 58, the retaining mechanism 56 and/or portable electronic device 18 may be pivoted or tilted so that the camera is able to view the target 14. Once the portable electronic device 18 has been properly positioned and angled, it can be locked in place with a manual lock 68, such as the illustrated thumbscrew. The thumbscrew 68 extends through an aperture 70 of a wall 72 and when tightened comes into contact with the wall 72 so as to hold the portable electronic device 18 at the desired angle and placement. The manual locking wheel 68 may be rotated in the opposite direction so as to loosen its grip on the portable electronic device 18 so as to provide further adjustment, or removal.

With reference now to FIGS. 1-4, in a particularly preferred embodiment, the distance between the first base 12 and the second base 16 can be selectively adjusted. Typically, the first and second bases 12 and 16 are slidably interconnected with one another, wherein a first rail 74 extending from the first base 12 is slidably engageable with a second rail 76 extending from the second base 16 to form a slide. The first rail 74 and second rail 76 slidably interconnect with one another to form a slide between the first and second bases 12 and 16. As illustrated, a cavity 78 having projections 80 of the first rail 74 receives the second rail 76 therein, such that the projections 80 extend into grooves or channels 82 of the second rail 76. This would form a tongue and groove type of an arrangement wherein the first and second slides 74 and 76 can be slidably adjusted with respect to one another. This enables the target 14 to be adjusted in distance to the camera 22 of the portable electronic device 18. Moreover, the interconnection of the first and second rails 74 and 76 generally align the first and second bases 12 and 16, and thus generally aligns the portable electronic device 18 with the target 14.

Typically, the bases 12 and 16 are placed on a relatively flat surface, such as the ground, a counter, table, or the like and the user positions himself or herself a desired distance away from the target 14. However, it is contemplated by the present invention that the system 10 be supported, such as using a tripod or the like. The tripod could be utilized to support the system 10 on an even ground, for example, or in order to raise the height of the target 14 to a desired level, such as the height approximating an animal or a human or the like. One of the bases 12 or 16 or slide rails 74 or 76 could include an internally threaded cavity or a threaded insert configured to receive a threaded end of a tripod to accomplish such purposes.

The laser spot reflections can generally be seen on the target 14 by the user when he or she is dry firing the gun 28 having a laser bullet 24 therein. However, when the farther the user is from the target 14 the more difficult it is for the user to view the laser light spots. Furthermore, the user may dry "fire" the firearm 28 multiple times, sometimes in rapid succession, and it is difficult for the user to ascertain where the laser spots hit on the target 14.

Thus, the invention incorporates a software application that is downloadable onto the portable electronic device 18 in order to capture and record the laser light reflections on the target 14. The software application utilizes the camera 22 of the portable electronic device 18 to detect the light spots generated by the light emitter, typically the laser bullet 24. The software application can be used to create a digital image or simulation of the target 14 and a record of the shots, comprising laser light reflections, on the target 14 and even tally a score as a means of motivating the user.

Figure 5:
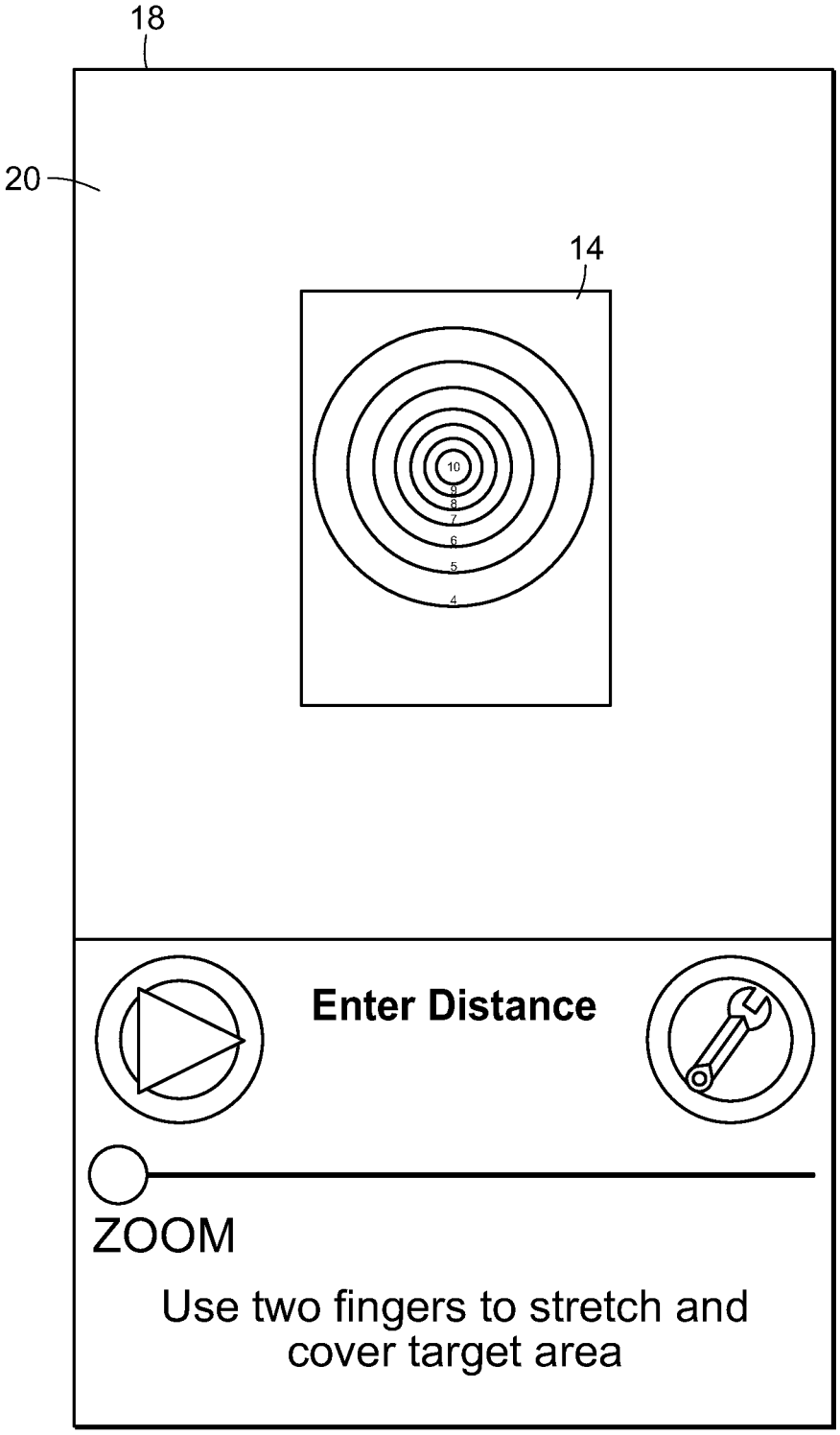
FIGS. 5-8 are diagrammatic views of screenshots on a display of a portable electronic device illustrating use of a software application downloaded onto the portable electronic device for detecting light spots generated by a light emitter reflecting from the target to simulate target shooting practice.
Figure 6:
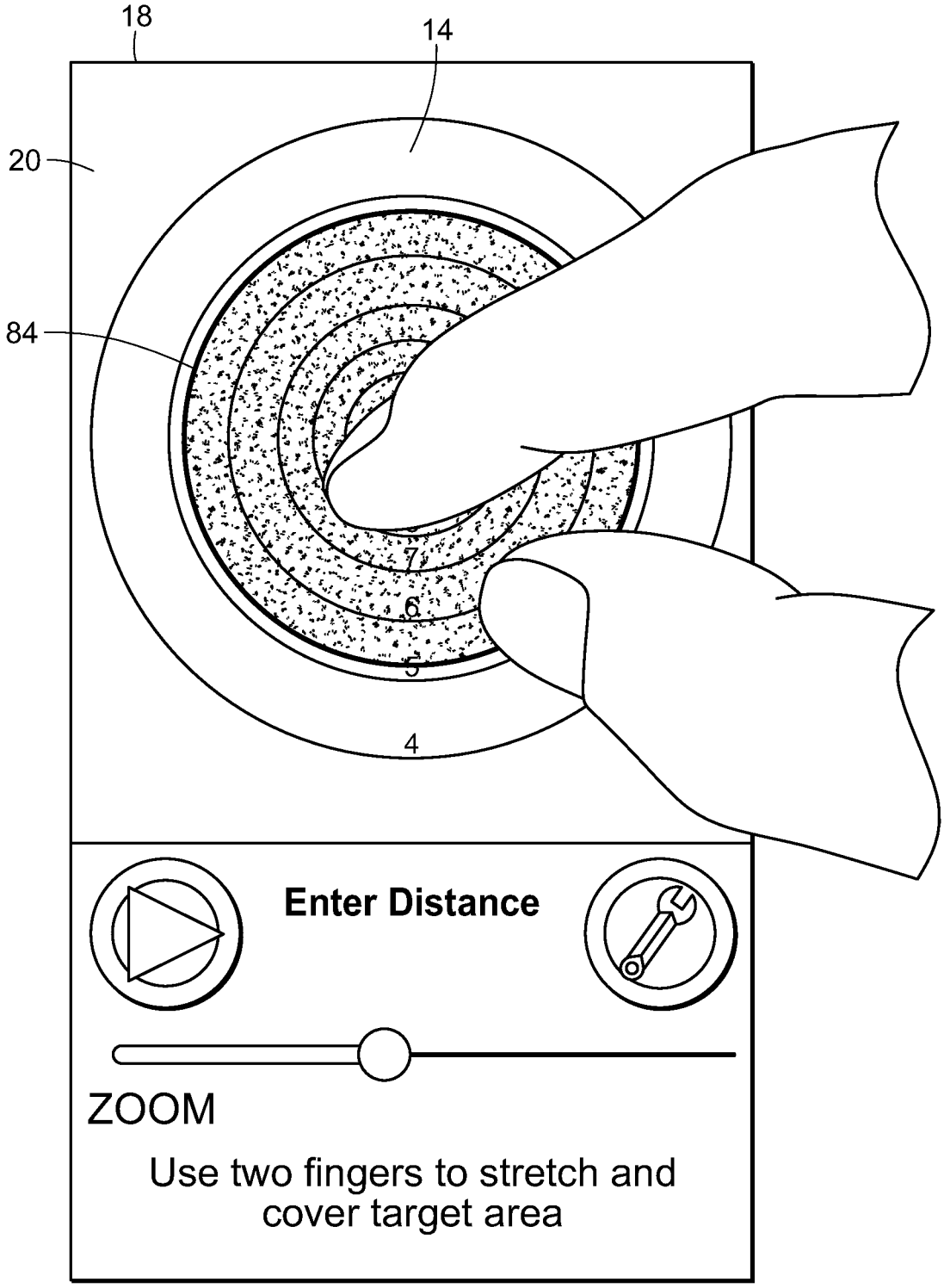

With reference now to FIG. 5, a screenshot of the display 20 of the portable electronic device 18 is shown wherein the target 14 captured by the camera 22 of the portable electronic device 18 is displayed. The user can enter a distance between the portable electronic device 18 and the target 14 and/or utilize the touchscreen 20 to enlarge or reduce the size of the target, such as by zooming in or out on the target 14. The user then creates an electronic and digital overlay 84 over the image of the target 14 so as to create a digital target 84 corresponding to the actual target 14, as illustrated in FIG. 6.

Figure 7:
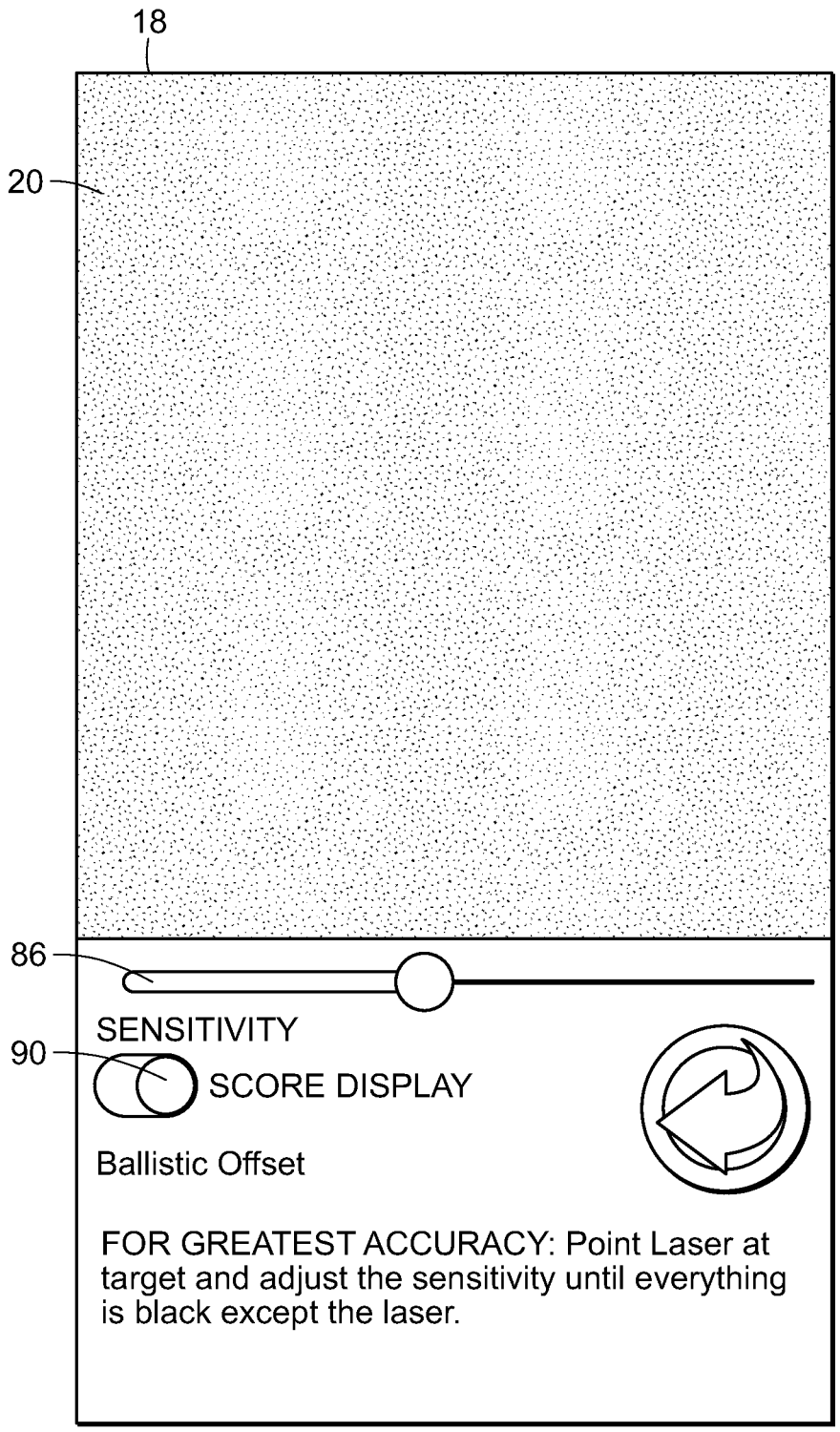

With reference to FIG. 7, in some instances, the sensitivity of the camera 22 and software must be adjusted in order to adjust for the lighting conditions, such that the software properly detects the actual laser light beam spot reflections, and not other reflections. Thus, for example, when using outdoors during daylight hours, the sensitivity may need to be raised or lowered such that reflections from the sun on the target 14 will not be detected as "shots". This could also be the case when used indoors and trying to accommodate and compensate for light reflected from lamps, overhead lighting or the like. However, when used in a darker setting, the sensitivity can be lowered. Using the touchscreen 20, the user may actuate a slide 86 to adjust the sensitivity, such that ambient light and reflections other than the reflections from the laser light beam are not detected and falsely interpreted as shots made on the target.

Figure 8:
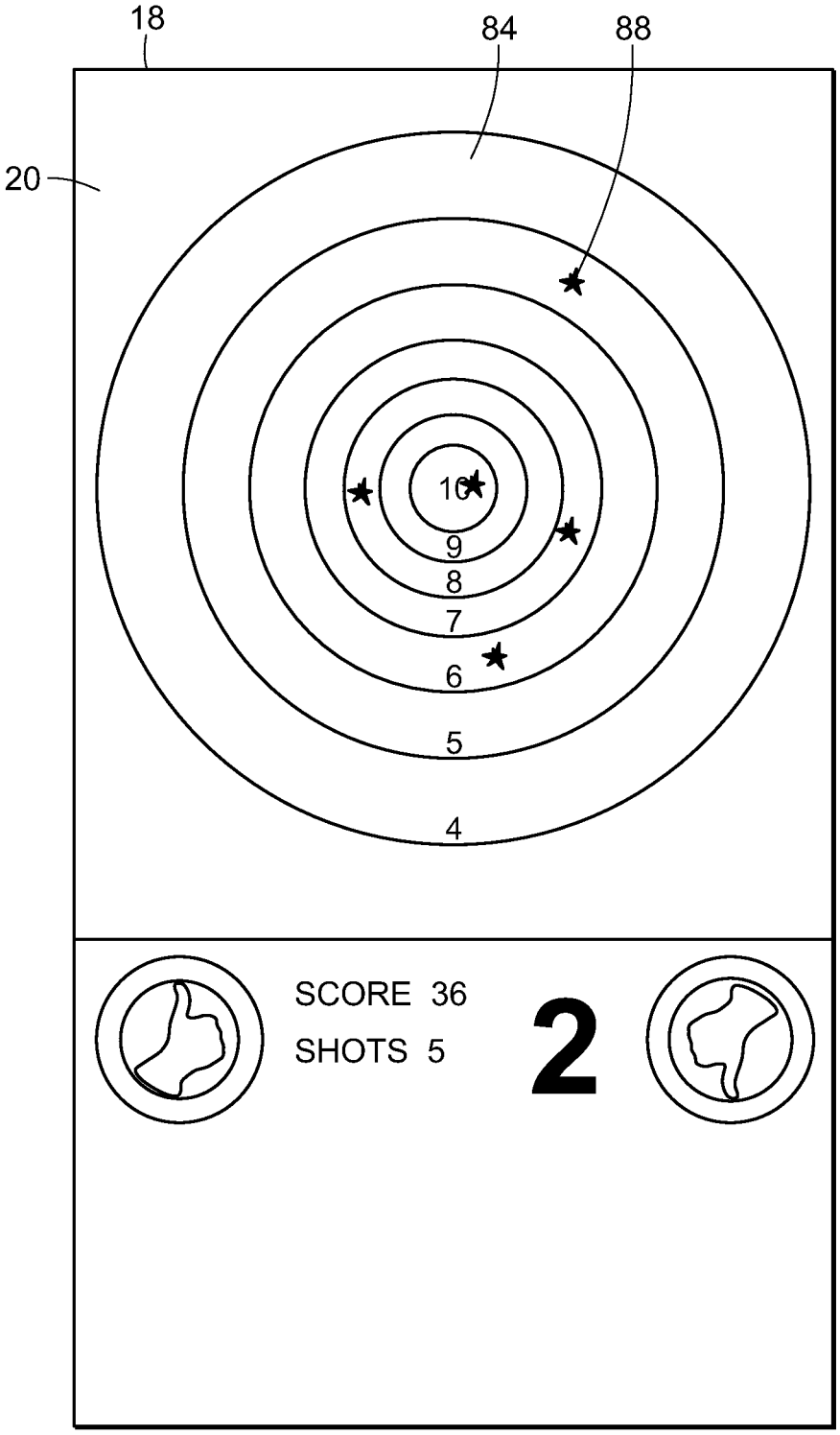

With reference to FIG. 8, once the digital target overlay 84 has been created and the sensitivity adjusted, the user can place himself or herself at a desired distance from the target 14 and dry fire practice shoot onto the target 14. The laser light reflections will be caught by the camera 22 of the portable electronic device 18 and the software will generate corresponding markings 88 on the digitally created target 84. These markings 88 preferably mimic holes created by real bullets in a real paper target, thus representing small tears. However, these are digitally created on the location of the digital target 84 corresponding to where the laser light reflected on the actual target 14. This is saved so that the user can view the "target" 84 and see the "shots" by virtue of markings 88 on the digital target 84 and determine how well he or she did with respect to accuracy in shooting at the target. The user can then opt to save the digital target 84 with markings 88 for later use or reference.

As illustrated in FIGS. 7 and 8, the user may opt for a score display, wherein the software will detect how many shots have been fired onto the target 14, by virtue of the detected laser light reflections, and provide a score depending upon how accurate the shooter was. For example, when hitting the bullseye, a score of ten points will be given. The software can tally the scores in real time to arrive at an overall score and may provide feedback, such as a green thumbs up or a red thumbs down to provide the user a gauge of the accuracy of his or her dry fire practice shooting session.

Aside from visual feedback either by the user being able to see the laser light reflected onto the actual target 14 and/or the markings 88 on the digitally created target 84, the present invention contemplates providing audible feedback as well. The software application may generate a simulated gunshot each time a laser spot reflection is detected, which is emitted from the speaker of the portable electronic device 18. Typically, in prior art dry fire shooting systems, no sound is generated during the dry fire practice shooting session as a laser light is generated, such as from a simulated handgun or rifle. The present invention, however, mimics an actual experience of a shooting range wherein a gunshot is heard each time the trigger is depressed and a laser light spot is reflected off of the target 14. This provides a much more accurate and realistic and enjoyable experience for the shooter utilizing the system 10 of the present invention.

Figure 4:
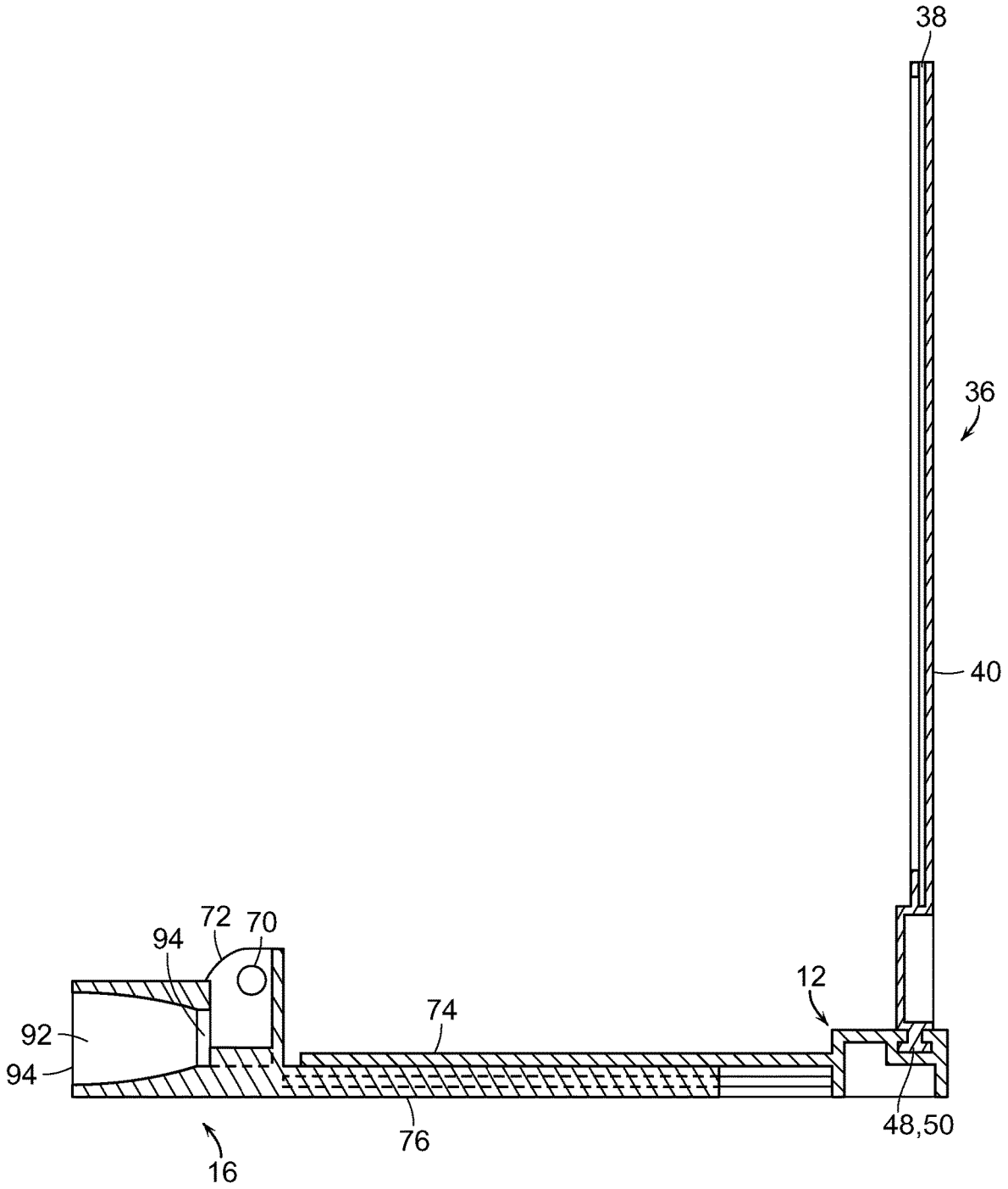
FIG. 4 is a cross-sectional view illustrating the interconnection of the first and second base by rails forming a slide.

With reference to FIGS. 1, 3 and 4, in order to augment the sound of the simulated gunfire, the second base defines an acoustic amplifying chamber 92 that amplifies the sounds emitted from the portable electronic device 18 as laser light reflection shots are detected on the target 14. As illustrated, the acoustic amplifying chamber 92 is a relatively large chamber having one end 94 open to the speaker of the portable electronic device 18, when inserted into the well 54 of the second base 16, and an open end 96 which is typically larger in diameter such that the sound waves are amplified as they travel through chamber 92 and out towards the shooter. As the shooter is typically positioned behind the second base 16, the sound is amplified and emitted towards the shooter as he or she is shooting during the dry fire practice shooting session. While a passive amplification within acoustic chamber 92 may be used, as described above, the present invention also contemplates an active electronic amplification which would utilize a speaker coupled to a power source, such as a battery or the like.

Although several embodiments have been described in detail for purposes of illustration, various modifications may be made without departing from the scope and spirit of the invention. Accordingly, the invention is not to be limited, except as by the appended claims.

What is claimed is:

1. A portable dry fire practice shooting system, comprising:

a first base supporting a target; and a second base associated with the first base such that the distance between the first base and second base can be selectively adjusted, the second base including a portable electronic device retaining mechanism for holding a portable electronic device on the second base so as to align a camera of the portable electronic device with the target;

wherein a slide interconnects the first base and the second base; and wherein the electronic device detects a light spot generated on the target by a light emitter of an actual or simulated firearm.

2. The system of claim 1, wherein the slide comprises a first rail extending from the first base and a second rail extending from the second base and in slidable engagement with the first rail.

3. The system of claim 1, including a target frame extending from the first base.

4. The system of claim 3, wherein the target is removably held by the target frame.

5. The system of claim 4, wherein the target frame includes an open edge and channels formed along generally opposite side walls for removably retaining the target therein.

6. The system of claim 3, wherein the target frame is movably connected to the first base.

7. The system of claim 6, wherein the first base and target frame are connected by a tongue and groove connection, permitting the target frame to be slidably moved with respect to the first base.

8. The system of claim 3, wherein the target frame is detachably connected to the first base.

9. The system of claim 1, wherein the second base defines an acoustic amplifying chamber that amplifies sounds emitted from the portable electronic device.

10. The system of claim 1, wherein the portable electronic device retaining mechanism is selectively adjustable to retain portable electronic devices of varying sizes.

11. The system of claim 10, wherein the portable electronic device retaining mechanism comprises a bracket for holding the portable electronic device, including an arm extendible away from the bracket and biased in a closed position towards the bracket to retain the portable electronic device within the bracket.

12. The system of claim 11, wherein the electronic device retaining mechanism is configured to selectively adjust an angle of the portable electronic device with respect to the target.

13. The system of claim 12, including a manual lock for locking the portable electronic device at a selected angle.

14. The system of claim 1, including a software application downloaded onto the portable electronic device that utilizes the camera of the portable electronic device to detect light spots generated by the light emitter reflecting from the target and create an image of simulated shot markings on the target which are displayed on an electronic display of the portable electronic device.

15. The system of claim 14, wherein the light emitter comprises a laser bullet actuated by a hammer or firing pin of the firearm.

16. A portable dry fire practice shooting system, comprising:

a first base;

a target frame movably connected to the first base for holding a target;

a second base spaced from the first base;

a slide interconnecting the first base and the second base, wherein the distance between the first base and second base can be selectively adjusted;

a portable electronic device retaining mechanism associated with the second base selectively adjustable to retain portable electronic devices of varying sizes to the second base and for adjusting an angle of the portable electronic device with respect to the target so as to align a camera of the electronic device with the target;

wherein the electronic device detects a light spot generated on the target by a light emitter of an actual or simulated firearm.

17. The system of claim 16, wherein the slide comprises a first rail extending from the first base and a second rail extending from the second base and in slidable engagement with the first rail.

18. The system of claim 16, wherein the target frame includes an open edge and channels formed along generally opposite side walls for removably retaining the target therein.

19. The system of claim 16, wherein the first base and target frame are connected by a tongue and groove connection, permitting the target frame to be slidably moved with respect to the first base.

20. The system of claim 16, wherein the second base defines an acoustic amplifying chamber that amplifies sounds emitted from the electronic device.

21. The system of claim 16, wherein the portable electronic device retaining mechanism comprises a bracket for holding the portable electronic device, including an arm extendible away from the bracket and biased in a closed position towards the bracket to retain the portable electronic device within the bracket.

22. The system of claim 16, including a manual lock for locking the portable electronic device at a selected angle.

23. The system of claim 16, including a software application downloaded onto the portable electronic device that utilizes the camera of the portable electronic device to detect light spots generated by the light emitter reflecting from the target and create an image of simulated shot markings on the target which are displayed on an electronic display of the portable electronic device.

24. The system of claim 23, wherein the light emitter comprises a laser bullet actuated by a hammer or firing pin of the firearm.

25. A portable dry fire practice shooting system, comprising:

a first base supporting a target;

a target frame extending from and movably connected to the first base; and a second base associated with the first base such that the distance between the first base and second base can be selectively adjusted, the second base including a portable electronic device retaining mechanism for holding a portable electronic device on the second base so as to align a camera of the portable electronic device with the target;

wherein the electronic device detects a light spot generated on the target by a light emitter of an actual or simulated firearm.

26. The system of claim 25, wherein a slide interconnects the first base and the second base.

27. The system of claim 26, wherein the slide comprises a first rail extending from the first base and a second rail extending from the second base and in slidable engagement with the first rail.

28. The system of claim 25, wherein the target is removably held by the target frame.

29. The system of claim 28, wherein the target frame includes an open edge and channels formed along generally opposite side walls for removably retaining the target therein.

30. The system of claim 25, wherein the first base and target frame are connected by a tongue and groove connection, permitting the target frame to be slidably moved with respect to the first base.

31. The system of claim 25, wherein the target frame is detachably connected to the first base.

32. The system of claim 25, wherein the second base defines an acoustic amplifying chamber that amplifies sounds emitted from the portable electronic device.

33. The system of claim 25, wherein the portable electronic device retaining mechanism is selectively adjustable to retain portable electronic devices of varying sizes.

34. The system of claim 33, wherein the portable electronic device retaining mechanism comprises a bracket for holding the portable electronic device, including an arm extendible away from the bracket and biased in a closed position towards the bracket to retain the portable electronic device within the bracket.

35. The system of claim 34, wherein the electronic device retaining mechanism is configured to selectively adjust an angle of the portable electronic device with respect to the target.

36. The system of claim 35, including a manual lock for locking the portable electronic device at a selected angle.

37. The system of claim 25, including a software application downloaded onto the portable electronic device that utilizes the camera of the portable electronic device to detect light spots generated by the light emitter reflecting from the target and create an image of simulated shot markings on the target which are displayed on an electronic display of the portable electronic device.

38. The system of claim 37, wherein the light emitter comprises a laser bullet actuated by a hammer or firing pin of the firearm.

39. A portable dry fire practice shooting system, comprising:

a first base supporting a target;

a target frame extending from and detachably connected to the first base; and a second base associated with the first base such that the distance between the first base and second base can be selectively adjusted, the second base including a portable electronic device retaining mechanism for holding a portable electronic device on the second base so as to align a camera of the portable electronic device with the target;

wherein the electronic device detects a light spot generated on the target by a light emitter of an actual or simulated firearm.

40. The system of claim 39, wherein a slide interconnects the first base and the second base.

41. The system of claim 40, wherein the slide comprises a first rail extending from the first base and a second rail extending from the second base and in slidable engagement with the first rail.

42. The system of claim 39, wherein the target is removably held by the target frame.

43. The system of claim 42, wherein the target frame includes an open edge and channels formed along generally opposite side walls for removably retaining the target therein.

44. The system of claim 39, wherein the target frame is movably connected to the first base, the first base and target frame being connected by a tongue and groove connection, permitting the target frame to be slidably moved with respect to the first base.

45. The system of claim 39, wherein the second base defines an acoustic amplifying chamber that amplifies sounds emitted from the portable electronic device.

46. The system of claim 39, wherein the portable electronic device retaining mechanism is selectively adjustable to retain portable electronic devices of varying sizes.

47. The system of claim 46, wherein the portable electronic device retaining mechanism comprises a bracket for holding the portable electronic device, including an arm extendible away from the bracket and biased in a closed position towards the bracket to retain the portable electronic device within the bracket.

48. The system of claim 47, wherein the electronic device retaining mechanism is configured to selectively adjust an angle of the portable electronic device with respect to the target.

49. The system of claim 48, including a manual lock for locking the portable electronic device at a selected angle.

50. The system of claim 39, including a software application downloaded onto the portable electronic device that utilizes the camera of the portable electronic device to detect light spots generated by the light emitter reflecting from the target and create an image of simulated shot markings on the target which are displayed on an electronic display of the portable electronic device.

51. The system of claim 50, wherein the light emitter comprises a laser bullet actuated by a hammer or firing pin of the firearm.

52. A portable dry fire practice shooting system, comprising:

a first base supporting a target; and a second base associated with the first base such that the distance between the first base and second base can be selectively adjusted, the second base including a portable electronic device retaining mechanism for holding a portable electronic device on the second base so as to align a camera of the portable electronic device with the target;

wherein the second base defines an acoustic amplifying chamber that amplifies sounds emitted from the portable electronic device.

53. The system of claim 52, wherein a slide interconnects the first base and the second base.

54. The system of claim 53, wherein the slide comprises a first rail extending from the first base and a second rail extending from the second base and in slidable engagement with the first rail.

55. The system of claim 52, including a target frame extending from the first base.

56. The system of claim 55, wherein the target is removably held by the target frame.

57. The system of claim 56, wherein the target frame includes an open edge and channels formed along generally opposite side walls for removably retaining the target therein.

58. The system of claim 55, wherein the target frame is movably connected to the first base.

59. The system of claim 58, wherein the first base and target frame are connected by a tongue and groove connection, permitting the target frame to be slidably moved with respect to the first base.

60. The system of claim 55, wherein the target frame is detachably connected to the first base.

61. The system of claim 52, wherein the portable electronic device retaining mechanism is selectively adjustable to retain portable electronic devices of varying sizes.

62. The system of claim 61, wherein the portable electronic device retaining mechanism comprises a bracket for holding the portable electronic device, including an arm extendible away from the bracket and biased in a closed position towards the bracket to retain the portable electronic device within the bracket.

63. The system of claim 62, wherein the electronic device retaining mechanism is configured to selectively adjust an angle of the portable electronic device with respect to the target.

64. The system of claim 63, including a manual lock for locking the portable electronic device at a selected angle.

65. The system of claim 52, including a software application downloaded onto the portable electronic device that utilizes the camera of the portable electronic device to detect light spots generated by a light emitter reflecting from the target and create an image of simulated shot markings on the target which are displayed on an electronic display of the portable electronic device.

66. The system of claim 65, wherein the light emitter comprises a laser bullet actuated by a hammer or firing pin of a firearm.

67. A portable dry fire practice shooting system, comprising:

a first base supporting a target;

a second base connected to the first base, the second base including a portable electronic device retaining mechanism for holding a portable electronic device on the second base so as to align a camera of the portable electronic device with the target; and a software application downloaded onto the portable electronic device that utilizes the camera of the portable electronic device to detect light spots generated by a light emitter reflecting from the target and create an image of simulated shot markings on the target which are displayed on an electronic display of the portable electronic device.

68. The system of claim 67, wherein a slide interconnects the first base and the second base such that the distance between the first and second bases can be selectively adjusted.

69. The system of claim 68, wherein the slide comprises a first rail extending from the first base and a second rail extending from the second base and in slidable engagement with the first rail.

70. The system of claim 67, including a target frame extending from the first base.

71. The system of claim 70, wherein the target is removably held by the target frame.

72. The system of claim 71, wherein the target frame includes an open edge and channels formed along generally opposite side walls for removably retaining the target therein.

73. The system of claim 70, wherein the target frame is movably connected to the first base.

74. The system of claim 73, wherein the first base and target frame are connected by a tongue and groove connection, permitting the target frame to be slidably moved with respect to the first base.

75. The system of claim 70, wherein the target frame is detachably connected to the first base.

76. The system of claim 67, wherein the second base defines an acoustic amplifying chamber that amplifies sounds emitted from the portable electronic device.

77. The system of claim 67, wherein the portable electronic device retaining mechanism is selectively adjustable to retain portable electronic devices of varying sizes.

78. The system of claim 77, wherein the portable electronic device retaining mechanism comprises a bracket for holding the portable electronic device, including an arm extendible away from the bracket and biased in a closed position towards the bracket to retain the portable electronic device within the bracket.

79. The system of claim 78, wherein the electronic device retaining mechanism is configured to selectively adjust an angle of the portable electronic device with respect to the target.

80. The system of claim 79, including a manual lock for locking the portable electronic device at a selected angle.

81. The system of claim 67, wherein the light emitter comprises a laser bullet actuated by a hammer or firing pin of a firearm.

* * * * *